United States Patent [19]

Keys

[11] Patent Number: 4,678,562

[45] Date of Patent: Jul. 7, 1987

[54] PROMOTORS FOR FROTH FLOATATION OF COAL

[75] Inventor: Robert O. Keys, Columbus, Ohio

[73] Assignee: Sherex Chemical Company, Inc., Dublin, Ohio

[21] Appl. No.: 830,572

[22] Filed: Feb. 18, 1986

Related U.S. Application Data

[60] Division of Ser. No. 585,176, Mar. 1, 1984, Pat. No. 4,589,980, which is a continuation-in-part of Ser. No. 434,243, Oct. 14, 1982, abandoned, and Ser. No. 434,244, Oct. 14, 1982, abandoned.

[51] Int. Cl.[4] ..... B03D 1/06
[52] U.S. Cl. ..... 209/166; 252/61
[58] Field of Search ..... 209/166, 167; 252/61

[56] References Cited

U.S. PATENT DOCUMENTS

| | | | |
|---|---|---|---|
| 2,690,259 | 9/1954 | Anderson | 209/166 |
| 4,090,972 | 5/1978 | Wang et al. | 252/61 |
| 4,253,944 | 3/1981 | Hefner | 209/166 |

FOREIGN PATENT DOCUMENTS

| | | | |
|---|---|---|---|
| 542966 | 7/1957 | Canada | 252/61 |
| 2734670 | 3/1978 | Fed. Rep. of Germany | 209/166 |
| 668710 | 6/1979 | U.S.S.R. | 209/166 |
| 712128 | 1/1980 | U.S.S.R. | 209/166 |
| 986504 | 1/1983 | U.S.S.R. | 252/61 |
| 1071320 | 2/1984 | U.S.S.R. | 252/61 |

OTHER PUBLICATIONS

Leja, *Surface Chemistry of Froth Flotation*, pp. 307–319, (1982).

*Primary Examiner*—Kenneth M. Schor
*Assistant Examiner*—Andrew J. Anderson
*Attorney, Agent, or Firm*—Mueller and Smith

[57] ABSTRACT

Disclosed is an improved process wherein coal particles are beneficiated by froth flotation under coal froth flotation conditions to separate the desired coal particles from remaining unwanted ash and like gangue material. The improvement of the present invention comprises conducting the froth flotation in the presence of an effective proportion of a hydrophobic, non-ionc promoter which is a $C_{12}$–$C_{30}$ fatty alcohol or its $C_3$ or higher alkoxylated derivative.

9 Claims, No Drawings

PROMOTORS FOR FROTH FLOATATION OF COAL

CROSS-REFERENCE TO RELATED APPLICATIONS

This application is a division of U.S. Ser. No. 585,176, filed on Mar. 1, 1984, now, U.S. Pat. No. 4,589,980, which application is a continuation-in-part of U.S. Ser. No. 434,243 and U.S. Ser. No. 434,244, both filed on Oct. 14, 1982 and now abandoned.

BACKGROUND OF THE INVENTION

The present invention relates to the froth flotation of finely-divided coal particles for separation of ash therefrom and more particularly to a new promoter which enhances the coal recovery in the froth flotation process.

Coalification is a natural process which results in the deposits of combustible carbonaceous solids in combination with some non-combustible mineral matter. Most coal cleaning is carried out by gravity separation methods utilizing jigs, shaking tables, heavy media or cyclones, and like techniques. The fine coal therefrom has been incorporated into clean coal or simply discarded in the past; however, due to economic and environmental considerations gained by recovery of the fine coal fraction, fine coal beneficiation has become a necessity in most coal operations requiring any degree of preparation. Froth flotation is one method which has been practiced for cleaning the fine coal.

The use of froth flotation to effect a separation of pyritic sulfur and ash particles from coal can be achieved only if liberation of these unwanted particles from the coal has taken place. Most high-grade coals are floatable naturally due to their hydrophobic surface and typically only require a frothing agent for effecting flotation. A frothing agent imparts elasticity to the air bubble, enhances particlebubble attachment so that the coal is buoyed to the surface of the slurry. The flotability of coal can vary within a given seam at a mine depending upon the exposure of the locale to weathering elements or the blending of coals from different seams. Butuminous and lower grade coals either possess an oxidized condition as mined or undergo oxidation (weathering) when the coal is stored or stockpiled for later processing. Coal that has been oxidized does not respond well to froth flotation. As the degree of oxidation increases, coal becomes increasingly hydrophilic and, therefore, less coal readily can be floated. Heretofore, oxidized coal which was not flotable was discarded in the tailing of the flotation process with little attempt to recover this loss being undertaken.

Recently, though, technology has emerged for practicing froth flotation of oxidized and other difficult to float coal particles. For example, U.S. Pat. No. 4,253,944 shows a promoter which is the condensation product of a fatty acid or fatty acid ester with an ethoxylated or propoxylated amine. U.S. Pat. No. 4,308,133 shows a promoter which is an aryl sulfonate. European patent application Publication No. 16914, Oct. 15, 1980, shows a promoter which is an alkanol amine-tall oil fatty acid condensate. U.S. Pat. No. 4,305,815 shows a promoter which is a hydroxy alkylated polyamine. U.S. Pat. No. 4,278,533 shows a promoter which is a hydroxylated ether amine. U.S. Pat. No. 4,196,092 shows a conditioning agent of a frother and a bis(alkyl)ester of a sulfosuccinic acid salt. United Kingdom Pat. No. 2,072,700 (and corresponding U.S. Pat. No. 4,340,467) floats coal with a latex emulsion prepared from a hydrocarbon oil with a hydrophobic water in oil emulsifier and a hydrophilic surfactant. Canadian Pat. No. 1,108,317 shows anionic surfactants which are fatty sulfosuccinates. Russian Inventor's Certificate No. 882,626 proposes a collector-frother which is an hydroxy, chloro or sulfide derivative of the methyl or ethyl ester of caproic acid.

Polish Pat. No. 104,569 proposes the use of ethoxylated higher fatty acids in coal flotation. U.S. Pat. No. 2,099,120 proposes the use of a water-soluble salt of a mono-ester of an organic dicarboxylic acid to float coal. British Pat. No. 741,085 proposes the flotation of coal by using salts of napthenic acids, cresylic acids, or rosin acids as wetting agents.

The foregoing art is consistent with accepted coal flotation principles that emulsified reagents should be used in coal froth flotation. While such promoters in the art can function in the coal flotation process, there is need for improving coal recoveries and improving the quality of the recovered coal. The present invention provides such improved high coal recoveries with improvements in coal quality utilizing a promoter which is highly effective and less expensive.

BROAD STATEMENT OF THE INVENTION

The present invention is directed to a froth flotation process for beneficiating coal wherein solid coal particles are selectively separated under coal froth flotation conditions as the froth phase from remaining solid feed particles as an aqueous phase in the presence of a coal particle collector which preferably is a fuel oil and frother. The improvement in such process is characterized by the addition of an effective proportion of a promoter comprising a non-ionic, hydrophobic, non-emulsified, aliphatic ester of an at least $C_{10}$ aliphatic carboxylic acid which is devoid of nitrogen and sulfur atoms or the carboxylic acid itself. The promoter works especially well in the flotation of coal particles which have highly oxidized surfaces. Preferred promoters include fatty acids and especially higher fatty acids, and alkyl esters thereof (e.g. mono, di, and triesters).

An additional class of promoters are nitrile promoters and espcially fatty nitriles having a chain length of about $C_{10}$–$C_{30}$. A further class of promoters is the oxified derivatives of the fatty acid, fatty acid ester, and nitrile promoters of the present invention. Oxified derivatives for present purposes comprehend the hydroxylated, alkoxylated, epoxidized, and oxidized derivatives of such promoters. The addition of this second oxygen-functional group is very beneficial to the float. Yet another class of promoters comprise $C_{10}$–$C_{30}$ higher fatty alcohols and their alkoxylated derivatives, especially propoxylated higher fatty alcohols. The promoters are non-emulsified (in water) and are non-ionic in character. The promoters are not miscible with water and form a distinct separate phase with water.

Advantages of the present invention include the ability to improve recovery of coal particles during the froth flotaton process without increasing the proportion of ash in the concentrate. Another advantage is that the ash in the concentrate usually is even lower when using the promoters of the present invention. Yet another advantage is the ability to improve the coal recovery utilizing a promoter which is inexpensive and which heretofore in some forms has been considered as a waste material.

DETAILED DESCRIPTION OF THE INVENTION

A wide variety of promoter carboxylic acids and esters thereof have been determined to be highly effective in enhancing or promoting the beneficiation of coal by the froth flotation process. Aliphatic carboxylic acids are preferred for their availability and cost, though aromatic carboxylic acids function in the process too. A wide variety of aliphatic carboxylic acids have been determined to function effectively as promoters in the froth flotation of coal particles and especially in promoting the froth flotation of highly oxidized coal particles. The aliphatic carboxylic acid collectors advantageously will have at least about 10 carbon atoms and generally the aliphatic carboxylic acids will be $C_{10}$–$C_{30}$ fatty aliphatic carboxylic acids and more often $C_{12}$–$C_{22}$ fatty acids, such as are typically found in vegetable oils (including nut), animal fat, fish oil, tall oil, and the like. Typical vegetable oils from which the fatty acids can be derived include, for example, the oils of coconut, corn, cottonseed, linseed, olive, palm, palm kernel, peanut, safflower, soy bean, sunflower, mixtures thereof and the like vegetable oils. Fatty acids can be recovered from such triglyceride oil sources, for example, by conventional hydrolysis of the oils. Tall oil fatty acids (including tall oil heads and bottoms) also form an advantageous promoter for the process and such fatty acids can be recovered from crude tall oil by solvent fractionation techniques or conventional distillation including molecular distillation. Synthetic fatty acids are comprehended as promoters too.

The fatty acids used as promoters for the present process can be separated or purified from mixtures thereof with related fatty acids or other fatty or lipoidal materials, depending in large part upon the source from which the fatty acids are derived and the particular operation employed to recover such fatty acids. Unsaturated fatty acids in admixture with relatively saturated fatty acids can be separated from such mixture by conventional distillation including molecular distillation, or by conventional fractional crystallization or solvent fractionation techniques. Alternatively and preferably, though, fatty acid promoters for the present process can be typical in composition of the oil or other source from which such fatty acids are derived. Typical dosages of the fatty acid promoter in the froth flotation process range from about 0.005 to about 2.0 grams of promoter per kilogram of coal particles.

The ester promoters are aliphatic partial or full esters of the promoter carboxylic acids described above (e.g. an ester of a monool or polyol). The aliphatic ester moeity can be a simple lower alkyl group, e.g. methyl, or can range up to a fatty group having up to about 30 carbon atoms, though typically the upper range of the carbon atom chain length will be about 22. Accordingly, the ester promoters can be mono, di, or tri-esters of glycerol, esters of tall oil, and the like. The dosages of the fatty acid ester promoter are the same as for the fatty acid promoter from which the ester promoters are derived. It should be noted that mixtures of the fatty acids and fatty acid esters are ideally suited for use as promoters in the process of the present invention.

The ester promoters of the present invention are non-ionic and hydrophobic. Neither the promoter nor the collector, e.g. fuel oil, are emulsified in an aqueous emulsion for use in the froth flotation process. The presence of nitrogen atoms in the form of an amine or an amide has been determined to detract from the utility of the promoters during the coal beneficiation process. As the examples will demonstrate, equivalent promoter molecules with and without amine and/or amide nitrogen atoms when used in the coal flotation process result in higher percentages of coal being recovered by the promoter which is devoid of such nitrogen atoms. Nitriles, however, have been found to function effectively as promoters as disclosed below. Ether linkages also can be tolerated.

An additional class of promoters comprises the oxified derivatives of the fatty acid and ester promoters described above. By oxified promoters is meant that the fatty acid or fatty acid ester promoters contain an additional carbon-bound oxygen group in the form of hydroxyl group, an epoxide group, or a carbonyl group. This additional functionality on the promoters has been found to provide excellent recoveries of coal which recoveries often exceed the basic fatty acid and fatty acid ester promoters recovery. The oxified promoters can be naturally occurring, such as castor oil (12 hydroxy-cis-9-octadecanoic acid), or oiticica oil (4-oxo-cis-9, trans-11, trans-13-octadecatrienoic) or the like. These naturally occurring oxified triglyceride esters can be split through conventional reactions with water or alcohol and converted into their corresponding fatty acids or partial esters to form promoters ideally suited according to the precepts of the present invention. Additionally, the promoters may be synthesized from a fatty acid or fatty acid ester promoter by conventional reactions well known in the art. For example, the fatty acid or ester may be epoxidized, oxidized, hydroxylated, or alkoxylated for formation of appropriate promoters. Epoxidation is conventionally practiced by reaction of the unsaturated acid or its ester with an epoxidizing agent such as, for example, peracetic acid or the like. Additional promoters can be synthesized from the epoxidized promoter through hydrogenation, acid catalysis (e.g. with boron trifluoride or the like), to form a fatty ester ketone, acid ketone or the like, or a simple reaction with water to form a fatty ester diol or acid diol.

Additional reactions for alkoxylation (hydroxylation) include the reaction of the ester or acid promoter with an alkylene oxide, preferably propylene oxide or a higher oxide. Oxidation may be accomplished for an unsaturated acid or ester promoter through simple blowing of air through the promoter or by use of oxidizing agents, such as potassium permanganate, for example, in an alkaline solution or by using elevated temperatures in an alkaline media. Fatty acid ketones also can be prepared using similar conditions with a corresponding fatty acid alcohol or ester alcohol. The Examples will set forth the advantageous promotion effect which such promoters provide in coal flotation.

A wide variety of nitriles have been determined to be highly effective in enhancing or promoting the froth flotation of coal particles as the examples will demonstrate. The only limitation on the nitrile promoters is that such promoters be soluble in or with another reagent used during the flotation process. Such other reagents generally include the collector and the frother. So long as the nitrile promoter is soluble in the collector and/or the frother, the nitrile promoter will function effectively and efficiently in the beneficiation of coal particles by froth flotation. Suitable nitrile promoters include substituted and unsubstituted nitriles including polynitriles (e.g. dimer fatty nitrile). Advantageous nitrile promoters include fatty nitriles derived from natural or synthetic fatty substances, typically fatty or fat-forming acids. Natural fatty substances include, for example, glyceride oils, nut oils, marine oils, and tall oil. Substituents on nitrile promoters can include, for example, ether, carboxylic acid, carboxylic acid alkyl esters, amine, ether amine, amide, aromatic groups, and like substituents. Such substituents have been determined not to detract from the enhancement provided by the nitrile group of the nitrile promoters. Specific preferred nitrile promoters include fatty nitriles (e.g. $C_{12}$–$C_{22}$ nitriles), dimer fatty nitriles, $C_{12}$–$C_{22}$ ether nitriles, and the like. Especially preferred nitriles for use as promoters are nitrile pitches. A pitch is the residue remaining from a distillation or other purification process applied to various nitrile substances. For example, a fatty nitrile which is subjected to distillation for providing a pure fatty nitrile product has a residue or pitch which remains at the bottom of the column. Today, such nitrile pitch usually is discarded or burned for its fuel content. Such pitches, however, have been found to function efficiently and effectively in the process as promoters and, due to their cost, are especially preferred.

Synthesis of the nitrile promoters is routine and includes the cyanoethylation of a fatty material, the dehydration of an amide, and the dehydration of a carboxylic acid ammonium salt. Other techniques are suitable for forming the nitrile also as those skilled in the art will appreciate. The particular manner for forming the nitrile promoter is unimportant. Typical dosages of the nitrile promoter in the froth flotation process range from about 0.005 to about 2.0 grams of promoter per kilogram of coal particles.

The nitrile promoters may be oxified also to provide a further class of promoters for use in the process of the present invention. For example, the nitrile promoter may be epoxidized with an epoxidizing agent as disclosed above. The epoxidized nitrile promoter then may be formed into a nitrile alcohol by hydrogenation, for example, a nitrile ketone by acid catalysis with boron trifluoride, for example, or a nitrile diol by reaction with water. Additionally, the nitrile promoter may be oxidized with air or a strong oxidizing agent and a nitrile ketone may be formed by a similar reaction from a corresponding nitrile alcohol. As with the fatty acid and fatty acid ester promoters, nitrile promoters are subject to enhanced promotion by addition of this second functionality of a carbon-bound oxygen group.

A still further class of promoters are higher fatty alcohol promoters and their alkoxylated derivatives. By "higher fatty alcohol" for present purposes is meant a $C_{12}$ or higher alcohol. Typically, such higher fatty alcohols will be $C_{14}$ or $C_{16}$ and higher alcohols often ranging up to $C_{30}$ though typically such alcohols will range up to about $C_{22}$ in chain length. While ethoxylated fatty alcohols do provide enhanced coal recovery, the resulting froth often is difficult to handle. Thus, it is distinctly preferred that the alkoxylated fatty alcohol promoters be alkoxylated with propylene oxide or a higher oxide. Fatty alcohols can be synthesized from corresponding higher fatty acids by conventional hydrogenation or other decarbonylation techniques known in the art. The Examples again will demonstrate the unexpected improvement in coal recovery realized by such higher fatty alcohol and alkoxylated alcohol promoters. Such results are surprising when considering that such alcohol and alcohol derivatives do not provide frothing action adequate to be termed as a frother by the coal froth flotation art.

The promoters of the present invention are non-emulsified and non-ionic, and are used with conventional collectors and frothers. Fuel oil is the preferred collector for use in the coal flotation process. Representative fuel oils include, for example, diesel oil, kerosene, Bunker C fuel oil, and the like and mixtures thereof. The fuel oil collector generally is employed in a dosage of from about 0.02 to about 2.5 gm/kg of coal feed. The precise proportion of collector depends upon a number of factors including, for example, the size, degree of oxidation and rank of the coal to be floated, and the dosages of the promoter and frother.

The frother or frothing agent used in the process is conventional and includes, for example, pine oil, cresol, isomers of amyl alcohol and other branched $C_4$–$C_8$ alkanols, and the like. Preferred frothing agents by the art, however, include methyl isobutyl carbinol (MIBC) and polypropylene glycol alkyl or phenyl ethers wherein the polypropylene glycol methyl ethers have a weight average molecular weight of from about 200 to 600. The dosage of frothing agent generally ranges from about 0.05 to about 0.5 gm/kg of coal feed. The precise proportion of frothing agent depends upon a number of factors such as those noted above relative to the conditioning agent. The preferred frother is disclosed in commonly-assigned application U.S. Ser. No. 454,607, filed Dec. 30, 1982, now U.S. Pat. No. 4,504,385, and comprises a polyhydroxy frother which has been modified to contain an ester group.

Suitable coal for beneficiation by the improved froth flotation process of the present invention includes anthracite, lignite, bituminous, subbituminous and like coals. The process of the present invention operates quite effectively on coals which are very difficult to float by conventional froth flotation techniques, especially where the surfaces of the coal particles are oxidized. The size of the coal particles fed to the process generally are not substantially above about 28 Tyler mesh (0.589 mm), though larger particles (e.g. less than 14 Tyler mesh or 1.168 mm), while difficult to float, may be floated successfully. In typical commercial froth flotation operations, coal particles larger than 28 Tyler mesh, advantageously larger than 100 Tyler mesh, may be separated from both inert material mined therewith and more finely divided coal by gravimetric separation techniques. The desirable cut or fraction of coal fed to the process for flotation preferably is initially washed and then mixed with sufficient water to prepare an aqueous slurry having a concentration of solids which promote rapid flotation. Typically, a solids concentration of from about 2% to about 20% by weight solids, advantageously between about 5 and 10 weight percent solids, is preferred. The aqueous coal slurry is conditioned with the collector and promoter, and any other adjuvants, by vigorously mixing or agitating the slurry prior to flotation in conventional manner. It should be noted that the promoters of the present invention can be used in separate form or can be premixed with the collector or the frother for use in the present invention. Any manner of incorporating the promoter into the froth flotation process has been determined to provide a much improved recovery of coal so long as all three ingredients are present in the float.

Typical commercial coal froth flotation operations provide a pH adjustment of the aqueous coal slurry prior to and/or during flotation to a value of about 4 to about 9 and preferably about 4 to 8. Such pH adjustment generally promotes the greatest coal recovery, though flotation at the natural coal pH is possible. If the coal is acidic in character, the pH adjustment is made generally by adding an alkaline material to the coal slurry. Suitable alkaline materials include, for example, soda, ash, lime, ammonia, potassium hydroxide or magnesium hydroxide, and the like, though sodium hydroxide is preferred. If the aqueous coal slurry is alkaline in character, an acid is added to the aqueous coal slurry. Suitable acids include, for example, mineral acids such as sulfuric acid, hydrochloric acid, and the like. The conditioned and pH-adjusted aqueous coal slurry is aerated in a conventional flotation machine or bowl to float the coal. The frothing agent or frother preferably is added to the aqueous coal slurry just prior to flotation or in the flotation cell itself.

The following examples show how the present invention can be practiced but should not be construed as limiting. In this application, all units are in the metric system, and all percentages and proportions are by weight, unless otherwise expressly indicated. Also, all references cites herein are expressly incorporated herein by reference.

IN THE EXAMPLES

Coal subjected to evaluation was comminuted to a particle size (Examples 1–7 and 12–16) of less than 28 Tyler mesh (0.589 mm) and then dispersed in water for conditioning with the fuel oil collector and promoter, if any, for about one minute. The flotation tests used 6.67% solids slurry of the conditioned coal which was pH adjusted to 7.0 with sodium hydroxide. The frother was MIBC (methyl isobutyl carbinol) in a dosage of about 0.2 gm/kg of coal (Examples 1–7 and 12–16), unless otherwise indicated, and all tests were conducted in a Denver Flotation Machine.

The various coals evaluated contained varying amounts of ash content (Examples 1–7 and 12–16) as follows: first Ohio coal, about 33% ash; second Ohio coal, about 50% ash; Western Kentucky coal, about 15% ash; West Virginia coal, about 21% ash; and Alberta (Canada) coal, about 62% ash.

The nitrile pitch promoter was a mixture of several different nitrile pitches derived from the product of several different fatty nitriles from a commercial chemical plant operating in this country. The precise proportions and types of nitrile pitches making up the mixture is unknown. The other nitrile promoters used in the examples were derived from vegetable, animal, and tall oil fatty acids as the names indicate. The weight percent of nitrile promoter set forth in the tables refers to the nitrile promoter in the diesel oil or other collector for forming a collector/promoter reagent.

EXAMPLE 1

The ester promoters of the present invention were compared to several substantially equivalent promoters which contained nitrogen atoms in the form of amine, amide, or combinations thereof. The following promoters were evaluated.

| Promoter No. | Promoter |
|---|---|
| N1 | Reaction product of a $C_{12}$–$C_{15}$ alkoxy propyl tallow diamine, tall oil fatty acids, and propylene oxide (1:3:3 molar ratio, respectively) |
| N2 | Reaction product of a tallow diamine, propylene oxide, and tall oil fatty acids (1:2:3 molar ratio, respectively) |
| N3 | Reaction product of iso-decyl ether propyl amine, ethylene oxide, and tall oil fatty acids (1:1:2 molar ratio, respectively) |
| N4 | Reaction product of tallow diamine and tall oil fatty acids (1:1 molar ratio) |
| E1 | Tallow alcohol ester of tall oil fatty acids |
| E2 | Mixture of various lower alkyl esters of soft tallow acid pitch |
| E3 | Diester of diethylene glycol and tall oil fatty acids |
| E4 | Methyl ester of tallow fatty acids |

Each promoter was dispersed at 10% by weight in diesel oil collector which collector/promoter was employed in a dosage of 0.30 gm/kg of coal for the West Virginia coal (21% ash) and 0.85 gm/kg coal for the Alberta (Canada) coal (62% ash). The frother dosage for the very high ash Alberta (Canada) coal was increased to about 0.28 gm/kg of coal. The Control run contained diesel oil collector with no promoter. The following flotation results were obtained.

TABLE 1

| Run No. | Promoter No. | Concentrate (wt. %) | Ash (wt. %) | Coal Recovery (wt. %) |
|---|---|---|---|---|
| West Virginia Coal | | | | |
| Control | — | 20.9 | 10.3 | 23.7 |
| 432 | N1 | 24.4 | 13.8 | 26.8 |
| 433 | N2 | 28.3 | 12.7 | 31.3 |
| 434 | N3 | 30.3 | 9.8 | 34.5 |
| 435 | N4 | 30.0 | 10.2 | 35.0 |
| 438 | E1 | 36.3 | 10.2 | 41.6 |
| 440 | E2 | 39.6 | 14.5 | 43.3 |
| 437 | E3 | 40.1 | 10.3 | 46.0 |
| 431 | E1 | 40.0 | 9.2 | 46.1 |
| Alberta (Canada) Coal | | | | |
| Control | — | 21.1 | 28.2 | 40.7 |
| 467 | N2 | 15.3 | 31.8 | 31.5 |
| 466 | N1 | 18.0 | 31.7 | 34.8 |
| 465 | N3 | 24.6 | 33.5 | 49.4 |
| 469 | N4 | 33.6 | 33.4 | 59.8 |
| 470 | E4 | 40.5 | 41.5 | 71.7 |
| 468 | E1 | 40.2 | 37.3 | 72.5 |
| 464 | E3 | 43.1 | 42.7 | 73.2 |
| 471 | E2 | 45.1 | 37.6 | 74.7 |

The above-tabulated results clearly demonstrate the excellent results which the ester promoters provide in the coal flotation process. The comparative promoters containing amine and amide groups consistently showed poorer promotion performance than did the ester promoters devoid of such nitrogen atoms. cl EXAMPLE 2

The first Ohio coal (33% ash) was floated with several different ester promoters in two different series of runs. The diesel oil collector/ester promoter combination was used in a dosage of 1.05 gm/kg of coal. The following table displays the results of the floats.

TABLE 2

| Run No. | Ester Promoter wt. % in Diesel Oil | Ester Promoter Type | Concentrate (wt. %) | Ash (wt. %) | Coal Recovery (wt. %) |
|---|---|---|---|---|---|
| Series A | | | | | |
| 40 | — | None | 25.1 | 17.2 | 31.4 |
| 62 | 10.0 | methyl tallowate | 59.5 | 19.8 | 73.6 |
| 63 | 10.0 | oleyl oleate | 57.4 | 14.6 | 73.0 |
| Series B | | | | | |
| 64 | — | None | 29.9 | 21.2 | 35.6 |
| 66 | 10.0 | tallow triglyceride | 46.2 | 19.5 | 57.8 |
| 67 | 10.0 | rape seed oil | 50.3 | 18.5 | 61.9 |
| 80 | 10.0 | *Polyester 523 | 55.9 | 19.1 | 70.1 |
| 81 | 10.0 | *Polyester 775 | 58.9 | 21.2 | 72.1 |
| 85 | 10.0 | *Polyester 523 | 56.9 | 21.3 | 69.5 |
| 86a | 10.0 | *Polyester 433 | 58.1 | 20.5 | 70.8 |
| 86b | 10.0 | *Diester 200 | 55.5 | 19.1 | 68.9 |
| 87 | 10.0 | *Diester 120 | 48.5 | 19.9 | 59.7 |

*Polyester 523 is a medium viscosity polyester (Gardner Color 3; viscosity 36 stokes at 25° C.; specific gravity 1.100, 25° C./25° C.; acid value 2.0; refractive index 1.514 at 25° C.)
Polyester 775 is a high viscosity polyester (Gardner color 1-; viscosity 56 stokes at 25° C.; specific gravity 1.095, 25° C./25° C.; acid value 1.3; refractive index 1.4670 at 25° C.)
Polyester 443 is a low viscosity polyester (Gardner color 3; viscosity 17.0 stokes at 25° C.; specific gravity 1.090, 25° C./25° C.; acid value 2.0; refractive index 1.5050 at 25° C.)
Diester 220 is the isodecyl alcohol diester of adipic acid
Diester 120 is the isodecyl alcohol diester of phthalic acid.

The above-tabulated results again demonstrate the effectiveness of the ester promoters in the float. Diesters, polyesters, and aromatic esters are shown to function effectively also.

EXAMPLE 3

Western Kentucky coal (15% ash) was floated in this series of runs using 0.525 gm/kg dosage of collector/promoter with the following results.

TABLE 3

| Run No. | Ester Promoter wt. % in Diesel Oil | Ester Promoter Type | Concentrate (wt. %) | Ash (wt. %) | Coal Recovery (wt. %) |
|---|---|---|---|---|---|
| 90 | — | (1.05 gm/kg diesel oil) | 64.4 | 11.7 | 76.3 |
| 91 | — | (0.525 gm/kg diesel oil) | 37.6 | 13.6 | 42.2 |
| 98 | 10.0 | Diester 220 | 71.7 | 10.7 | 84.1 |
| 99 | 10.0 | methyl tallowate | 69.7 | 10.6 | 81.4 |

Again, the effectiveness of the ester promoters is demonstrated to provide improved coal recoveries even at one-half the collector dosage.

EXAMPLE 4

Lots of the first Ohio coal (33% ash) were held at about 71° C. (160° F.) for 3 days in order to further oxide the coal. The highly oxidized coal then was floated with the following results.

TABLE 4

| Run No. | Ester Promoter wt. % in Diesel Oil | Ester Promoter Type | Concentrate (wt. %) | Ash (wt. %) | Coal Recovery (wt. %) |
|---|---|---|---|---|---|
| 104 | — | None | 28.6 | 25.3 | 32.7 |
| 110 | 10.0 | 1,4-butanediol diester of tall oil fatty acids | 47.9 | 21.4 | 58.7 |
| 111 | 10.0 | ethylene glycol diester of tall oil fatty acids | 49.7 | 20.2 | 59.5 |

These results demonstrate the remarkable improvements which can be realized by employing the ester promoters for floating very difficult-to-float coal.

EXAMPLE 5

The first Ohio coal (33% ash) was floated using fatty acid promoters and 0.25 gm/kg MIBC frother. The diesel oil/promoter dosage was 0.85 gm/kg coal.

TABLE 5

| Run No. | Fatty Acid Collector wt. % in Diesel Oil | Fatty Acid Collector Type | Concentrate (wt. %) | Ash (wt. %) | Coal Recovery (wt. %) |
|---|---|---|---|---|---|
| 596 | — | None | 45.3 | 11.8 | 58.1 |
| 496 | 10.0 | Coco fatty acids | 64.7 | 14.6 | 86.1 |
| 597 | 10.0 | Tall oil heads fatty acids | 64.7 | 13.4 | 84.2 |
| 598 | 10.0 | Tall oil fatty acids | 68.2 | 14.7 | 87.7 |
| 599 | 10.0 | Tall oil fatty acids | 65.9 | 13.9 | 87.3 |
| 600 | 10.0 | Dimer tall oil fatty acids | 65.6 | 13.2 | 84.9 |
| 601 | 10.0 | Diacid product of linoleic | 68.6 | 14.5 | 88.3 |

TABLE 5-continued

| Run No. | Fatty Acid Collector wt. % in Diesel Oil | Fatty Acid Collector Type | Concentrate (wt. %) | Ash (wt. %) | Coal Recovery (wt. %) |
|---|---|---|---|---|---|
| | | and acrylic acids | | | |
| 602 | 10.0 | $C_{10}$ fatty acid | 66.9 | 13.7 | 84.9 |
| 603 | 10.0 | $C_{12}$ fatty acid | 67.4 | 15.2 | 84.2 |

The above-tabulated results demonstrate the beneficial effect on the float imparted by the fatty acid promoters. The concentrate recovered has substantially increased while its ash content has only slightly increased. Thus, coal recovery also has substantially increased.

EXAMPLE 6

The second Ohio coal (50% ash) was floated using several different fatty acid promoters and 0.25 gm/kg MIBC frother. The diesel oil collector/fatty acid promoter blends were used in a dosage of 0.4 gm/kg of coal.

TABLE 6

| Run No. | Fatty Acid Collector wt. % in Diesel Oil | Fatty Acid Collector Type | Concentrate (wt. %) | Ash (wt. %) | Coal Recovery (wt. %) |
|---|---|---|---|---|---|
| 693 | — | None | 28.3 | 28.6 | 40.0 |
| 694 | 10.0 | Yellow grease fatty acids | 40.5 | 24.9 | 59.2 |
| 695 | 10.0 | $C_{12}$ fatty acids | 41.3 | 27.0 | 56.6 |
| 696 | 10.0 | Tall oil fatty acids | 42.9 | 25.0 | 60.4 |
| 697 | 10.0 | Diacid product of linoleic and acrylic acids | 47.0 | 27.6 | 63.7 |
| 698 | 10.0 | Dimer tall oil fatty acids | 38.1 | 25.4 | 51.8 |
| 699 | 10.0 | Coco fatty acids | 47.2 | 26.9 | 62.7 |
| 700 | 10.0 | $C_{10}$ fatty acid | 45.1 | 28.6 | 55.8 |

The invention again is demonstrated even for a coal that is one-half ash. The concentrate amounts recovered has increased substantially without an increase in its ash content.

EXAMPLE 7

West Virginia coal (33% ash) was floated with 0.25 gm/kg diesel oil collector and 0.2 gm/kg MIBC frother. In addition, various amine condensates and fatty acid promoters were evaluated in the floats. The promoters evaluated were tall oil fatty acids, an amine condensate promoter (reaction product of a $C_{12}$–$C_{15}$ alkoxy propyl tallow diamine, tall oil fatty acids, and propylene oxide in a 1:3:1 molar ratio, respectively), and a mixture thereof. The following test results were obtained:

TABLE 7A

| Run No. | Promoter Type | Promoter wt. % in Diesel Oil | Concentrate (wt. %) | Ash (wt. %) | Coal Recovery (wt. %) |
|---|---|---|---|---|---|
| 804 | — | None | 28.4 | 16.2 | 34.6 |
| 801 | Amine Condensate | 10.0 | 42.0 | 14.8 | 52.3 |
| 802 | Amine Condensate | 5.0 | 49.6 | 15.5 | 63.1 |
| | Tall Oil | 5.0 | | | |
| 800* | Tall Oil | 10.0 | 69.5 | 16.1 | 69.5 |

*Average of two runs

The above-tabulated results demonstrate that, though the amine promoter is beneficial to the float, the presence of the amine in admixture with the fatty acid promoter is adverse to maximizing coal recovery. Note the dramatic increase in the concentrate when the fatty acid promoter is used alone.

A further demonstration of the unexpected improvement in using fatty acids as promoters was observed when comparing the tall oil fatty acid promoter with an amine promoter consisting of the reaction product of the tallow diamine, tall oil fatty acids, and propylene oxide (1:1:2 molar ratio, respectively).

TABLE 7B

| Run No. | Promoter Type | Promoter wt. % in Diesel Oil | Concentrate (wt. %) | Ash (wt. %) | Coal Recovery (wt. %) |
|---|---|---|---|---|---|
| 804 | — | None | 28.4 | 16.2 | 34.6 |
| 799 | Amine Condensate | 10.0 | 40.4 | 17.5 | 50.5 |
| 798 | Tall Oil | 10.0 | 48.7 | 16.4 | 60.1 |

These results again show the improved coal recovery which pure fatty acids provide compared to amine-fatty acid condensates. A comparison of Run No. 802 from Table 8A and Run 798 from Table 8B appears to show that the presence of the amine condensate provides no margin of improved coal recovery than is provided from the tall oil fatty acids by themselves.

EXAMPLE 8

Western Kentucky coal (about 22% ash content, particle size less than 20 Tyler mesh or 0.833 mm) and Ohio coal (about 27–28% ash content, particle size less than 14 Tyler mesh or 1.168 mm) were floated with 10% by weight of various hydroxyl-containing fatty acid and fatty acid alkyl ester promoters dispersed in No. 2 diesel oil collector (0.44 g/kg dosage) and 0.16 g/kg MIBC frother for the Western Kentucky coal, and 0.105 g/kg diesel oil collector and 0.315 g/kg MIBC frother for the Ohio coal. Runs using corresponding fatty acid and ester promoters without hydroxyl groups also are reported.

TABLE 8

| Run No. | Promoter Type | Concentrate (wt %) | Ash (wt %) | Coal Recovery (wt %) |
|---|---|---|---|---|
| Western Kentucky Coal | | | | |
| 1513 | None | 19.5 | 15.2 | 21.1 |
| 1515 | Oleic acid | 55.8 | 11.3 | 62.3 |

TABLE 8-continued

| Run No. | Promoter Type | Concentrate (wt %) | Ash (wt %) | Coal Recovery (wt %) |
|---|---|---|---|---|
| 1514 | Castor Oil fatty acids | 65.7 | 11.9 | 74.2 |
| 1516 | Methyl oleate | 59.2 | 11.7 | 66.9 |
| 1517 | Methyl ricinoleate | 65.5 | 11.9 | 73.2 |
| Ohio Coal | | | | |
| 1582 | None | 36.9 | 14.1 | 43.4 |
| 1583 | Soybean oil triglyceride | 64.8 | 14.7 | 77.0 |
| 1584 | Castor oil triglyceride | 67.7 | 14.6 | 79.7 |
| 1585 | Oleic acid | 63.1 | 15.0 | 72.7 |
| 1586 | Castor oil fatty acids | 75.1 | 16.4 | 87.3 |
| 1587 | Methyl Oleate | 58.3 | 14.7 | 68.0 |
| 1588 | Methyl ricinoleate | 68.6 | 14.6 | 81.2 |
| 1589 | Linseed oil triglyceride | 64.9 | 14.2 | 76.7 |
| 1590 | Boiled linseed oil triglyceride | 66.3 | 14.4 | 79.3 |
| 1591 | *Castor oil fatty acids | 33.6 | 14.7 | 39.8 |
| 1592 | *Methyl ricinoleate | 29.4 | 14.3 | 34.8 |
| 1593 | *Soybean oil | 19.3 | 19.4 | 21.4 |

*No MIBC or other frother added.

The above-tabulated results demonstrate that the hydroxyl group addition to the fatty acid and ester promoters provides increased coal recovery without increased ash in the concentrate. Note also should be made of the extremely large particle size of the Ohio coal which was floated successfully using the novel promoters.

EXAMPLE 9

The same types of coal (except having about 25% ash content each) and reagent dosages of Example 8 were used to evaluate epoxidized fatty acid and ester promoters (10% by weight in #2 diesel oil collector). Comparative runs using prior art olefin oxides and runs using the non-epoxidized fatty acids and esters also are reported.

TABLE 9

| Run No. | Promoter Type | Concentrate (wt %) | Ash (wt %) | Coal Recovery (wt %) |
|---|---|---|---|---|
| Western Kentucky Coal | | | | |
| 1603 | None | 27.7 | 13.5 | 32.2 |
| 1636 | $C_{16}$ Olefin Oxide (Comparative) | 45.4 | 11.8 | 53.9 |
| 1637 | Soybean Oil triglyceride | 44.5 | 11.7 | 52.7 |
| 1638 | Epoxidized Soybean Oil triglyceride | 65.1 | 12.9 | 69.2 |
| 1640 | Methyl Oleate | 46.4 | 11.7 | 54.6 |
| 1639 | Epoxidized Tall Oil 2-ethyl hexyl ester | 59.1 | 11.8 | 76.6 |
| Ohio Coal | | | | |
| 1582 | None | 36.9 | 14.1 | 43.4 |
| 1641 | $C_{16}$ Olefin Oxide (Comparative) | 54.6 | 14.2 | 63.9 |
| 1643 | Soybean oil triglyceride | 60.7 | 12.9 | 73.3 |
| 1644 | Epoxidized Soybean Oil triglyceride | 73.4 | 14.1 | 87.1 |
| 1601 | Epoxidized Soybean Oil triglyceride | 71.9 | 14.2 | 84.4 |
| 1646 | Methyl Oleate | 60.0 | 14.8 | 70.7 |
| 1642 | Epoxidized tall oil 2-ethyl hexyl ester | 62.8 | 14.8 | 73.8 |
| 1602 | Split Epoxidized Soybean Oil | 63.6 | 16.1 | 73.6 |

The above-tabulated results again demonstrate the improvement which is experienced by adding additional functionality to the fatty acid and fatty acid ester promoters.

EXAMPLE 10

Western Kentucky coal (about 22–23% ash content, particle size less than 20 Tyler mesh, 0.833 mm) was floated with 10% by weight of various propoxylated fatty acid promoters dispersed in 0.44 g/kg No. 2 diesel oil collector and using 0.16 g/kg MIBC frother. Ohio coal (about 29.5% ash content, particle size less than 20 Tyler mesh, 0.833 mm) similarly was floated with 0.33 g/kg No. 2 diesel oil collector and 0.22 g/kg MIBC frother. Propoxylation was conducted using propylene oxide (PO as used below) with the number of moles added being set forth below.

TABLE 10

| Run No. | Promoter Type | Concentrate (wt %) | Ash (wt %) | Coal Recovery (wt %) |
|---|---|---|---|---|
| Western Kentucky Coal | | | | |
| 1505 | None | 26.3 | 12.4 | 29.1 |
| 1507 | Tall oil fatty acids | 61.5 | 11.7 | 69.2 |
| 1512 | Tall oil + 1.5 moles PO | 69.0 | 10.8 | 79.2 |
| 1508 | Tall oil + 10 moles PO | 66.7 | 11.7 | 75.8 |
| 1509 | $C_{16}$–$C_{18}$ fatty acid mixture | 47.3 | 12.8 | 53.0 |
| 1510 | $C_{16}$–$C_{18}$ Fatty acid mixture + 1.5 moles PO | 65.4 | 11.0 | 74.6 |
| 1511 | $C_{16}$–$C_{18}$ Fatty acid mixture + 10 moles PO | 63.0 | 12.0 | 71.0 |
| Ohio Coal | | | | |
| 1498 | None | 42.9 | 14.4 | 55.6 |
| 1500 | Tall oil fatty acids | 63.8 | 13.8 | 77.9 |
| 1499 | Tall oil fatty acids + 1.5 moles PO | 74.1 | 15.2 | 88.4 |
| 1501 | Tall oil fatty acids + 5 moles PO | 75.3 | 15.1 | 90.0 |
| 1502 | Tall oil fatty acids + 10 moles PO | 74.2 | 15.7 | 89.0 |
| 1504 | $C_{16}$–$C_{18}$ fatty acid mixture | 69.8 | 14.9 | 84.3 |
| 1503 | $C_{16}$–$C_{18}$ fatty acid mixture + 10 moles PO | 75.7 | 14.7 | 90.2 |

Again, the benefits imparted by the oxified (alkoxylated) fatty acid promoters is demonstrated. Also, an optimum number of moles of propylene oxide was reached. Additional moles or propylene oxide beyond such optimum resulted in no increase in coal recovery.

EXAMPLE 11

U.K. Pat. No. 2,093,735 and corresponding Offenlegungsschrift DE No. 3,107,305 propose to completely replace diesel oil collectors with vegetable oil collectors. The present invention, however, is directed to the use of vegetable oils (and other compounds) as promoters to promote diesel oil and like collectors. The heretofore unrecognized and unexpected benefit of such promoter use is demonstrated below on Western Kentucky coal (about 29% ash content, particle size less than 28 Tyler mesh of 0.589 mm) and on Ohio coal (about 32–33% ash content, particle size less than 14 Tyler mesh or 1.168 mm). The frother was MIBC at 0.135 g/kg for Western Kentucky Coal and 0.105 g/kg for Ohio coal. The triglyceride oil used in the Western Kentucky coal runs was soybean oil and rape seed oil for the Ohio coal runs.

TABLE 11

| Run No. | Soybean Oil Promoter (wt % in #2 Diesel Oil) | Total Dosage-Triglyceride Oil & #2 Diesel Oil (g/kg) | Concentrate Ash (wt %) | Concentrate Ash (wt %) | Coal Recovery (wt %) |
|---|---|---|---|---|---|
| Western Kentucky Coal | | | | | |
| 1885 | 0 | 0.70 | 42.6 | 10.6 | 54.0 |
| 1886 | 20 | 0.70 | 68.0 | 11.0 | 84.8 |
| 1890 | 50 | 0.70 | 64.7 | 10.3 | 81.9 |
| 1891 | 75 | 0.70 | 64.1 | 10.7 | 80.6 |
| 1886 | 100 | 0.70 | 61.0 | 10.1 | 76.7 |
| 1888* | 100 | 1.00 | 35.4 | 12.7 | 43.6 |
| Ohio Coal | | | | | |
| 1928 | 0 | 0.57 | 58.5 | 15.8 | 72.9 |
| 1929 | 20 | 0.57 | 72.5 | 16.9 | 88.0 |
| 1930 | 50 | 0.57 | 73.3 | 17.2 | 88.8 |
| 1931 | 75 | 0.57 | 69.3 | 16.9 | 84.2 |
| 1932 | 100 | 0.57 | 60.6 | 15.3 | 75.5 |

*No MIBC frother.

These results demonstrate that the fatty acid ester (e.g. triglyceride oil) was more beneficial in improving the float when used to promote or enhance the ability of conventional diesel oil or like collectors. The unexpectedness of the present invention, thus, is demonstrated.

EXAMPLE 12

The first Ohio coal (33% ash) was floated with several different classes and sources of nitriles in order to evaluate the efficacy of nitriles as promoters in the float. Diesel oil was used as the collector in all runs. The following table displays the results of such floats.

TABLE 12

| Run No. | Nitrile Promoter wt. % | Nitrile Promoter Type | Concentrate (wt. %) | Ash (wt. %) | Coal Recovery (wt. %) |
|---|---|---|---|---|---|
| 40 | — | None | 25.1 | 17.2 | 31.4 |
| 41 | 10.0 | nitrile pitch | 46.2 | 15.2 | 58.4 |
| 43 | 50.0 | nitrile pitch | 41.8 | 16.7 | 51.8 |
| 45 | 2.5 | soft tallow nitrile | 54.1 | 15.2 | 69.0 |
| 44 | 5.0 | soft tallow nitrile | 54.6 | 14.9 | 69.3 |
| 42 | 10.0 | soft tallow nitrile | 57.2 | 13.6 | 73.1 |
| 46 | 2.5 | tall oil nitrile | 55.2 | 14.6 | 70.7 |
| 47 | 5.0 | tall oil nitrile | 58.0 | 14.6 | 74.3 |
| 48 | 10.0 | tall oil nitrile | 52.1 | 12.6 | 68.3 |
| 50 | 2.5 | dimer nitrile | 59.6 | 15.7 | 73.8 |
| 51 | 5.0 | dimer nitrile | 61.2 | 15.0 | 77.5 |
| 52 | 10.0 | dimer nitrile | 65.8 | 15.1 | 84.4 |
| 49 | 10.0 | off-grade hard tallow nitrile | 59.4 | 14.0 | 75.1 |
| 57 | 10.0 | coco nitrile | 59.4 | 15.0 | 74.5 |
| 58 | 10.0 | $C_{14}$ ether nitrile | 43.0 | 16.2 | 54.0 |
| 59 | 10.0 | tallow amine trimethylene nitrile | 46.5 | 15.9 | 58.7 |

The above-tabulated results demonstrate that several different classes of nitriles are effective in improving the selectivity of floating coal. The ash content was reduced in every run using the nitrile promoters. Moreover, more coal was recovered in the concentrate and the concentrate amount increased also. The ability to use a pitch as the basis for a highly effective and selective promoter underscores the usually intense effect which the nitrile group has in the process. The only apparent limitation on the nitrile promoter is that it be solubilized by the collector and/or frother.

EXAMPLE 13

Additional lots of the first Ohio coal (33% ash) were subjected to froth flotation using the nitrile promoters with the following results.

TABLE 13

| Run No. | Nitrile Promoter wt. % | Nitrile Promoter Type | Concentrate (wt. %) | Ash (wt. %) | Coal Recovery (wt. %) |
|---|---|---|---|---|---|
| 64 | — | None | 29.9 | 21.2 | 35.6 |
| 65* | — | None | 28.5 | 23.9 | 33.0 |
| 74 | 5.0 | dimer nitrile | 50.0 | 18.4 | 63.0 |
| 75 | 10.0 | soft tallow nitrile | 51.8 | 20.6 | 62.2 |
| 76 | 10.0 | tall oil nitrile | 50.4 | 19.7 | 62.4 |

*Collector was Western Fuel Oil #5.

Again, the above-tabulated data demonstrates the effectiveness of the nitrile promoters in the coal flotation process.

EXAMPLE 14

In this example, the total proportion of reagents, fuel oil collector and nitrile promoter, were reduced to 0.525 gm/kg of Western Kentucky coal (15% ash). In run 90, the fuel oil dosage was 1.05 gm/kg coal and in run 90 the dosage was 0.525 gm/kg. Runs 92, 94, and 95 with the promoter also used a total dosage of collector and promoter of 0.525 gm/kg coal. The following results were experienced.

TABLE 14

| Run No. | Nitrile Promoter wt. % | Nitrile Promoter Type | Concentrate (wt. %) | Ash (wt. %) | Coal Recovery (wt. %) |
|---|---|---|---|---|---|
| 90 | — | None | 64.4 | 11.7 | 76.3 |
| 91 | — | None | 37.6 | 13.6 | 42.2 |
| 92 | 10.0 | soft tallow nitrile | 71.1 | 10.4 | 84.1 |
| 94 | 10.0 | tall oil nitrile | 63.7 | 10.7 | 75.5 |
| 95 | 10.0 | nitrile pitch (unfiltered) | 63.0 | 12.4 | 70.1 |

These results show that the nitrile promoters intensity in the process permits the total reagent concentration to be cut in half without any loss in concentrate amount or grade.

EXAMPLE 15

In order to demonstrate the efficacy of the nitrile promoters in improving the float of oxidized coal, lots of the first Ohio coal (33% ash) were held at about 71° C. (160° F.) for 3 days in order to further oxidize the coal. The highly oxidized coal then was floated with the following results.

TABLE 15

| Run No. | Nitrile Promoter wt. % | Nitrile Promoter Type | Concentrate (wt. %) | Ash (wt. %) | Coal Recovery (wt. %) |
|---|---|---|---|---|---|
| 104 | — | None | 28.6 | 25.3 | 32.7 |
| 106 | 10.0 | nitrile pitch | 42.4 | 19.5 | 53.7 |
| 107 | 10.0 | oleyl nitrile pitch | 49.6 | 19.7 | 60.7 |
| 112 | 10.0 | filtered nitrile pitch | 49.1 | 20.3 | 60.7 |
| 113 | 20.0 | filtered nitrile pitch | 49.4 | 20.9 | 59.7 |

These results demonstrate the remarkable improvements that can be realized by the present invention in floating very difficult-to-float coal. Note that the weight percent concentrate has been increased as well as has the amount of coal recovered.

EXAMPLE 16

Additional tests were conducted in the first Ohio coal (33% ash) in order to further demonstrate the present invention. The total reagent concentration (fuel oil and nitrile promoter) was 0.22 gm/kg of coal.

TABLE 16

| Run No. | Nitrile Promoter wt. % | Nitrile Promoter Type | Concentrate (wt. %) | Ash (wt. %) | Coal Recovery (wt. %) |
|---|---|---|---|---|---|
| 122 | — | None | 33.8 | 22.4 | 39.1 |
| 118 | 10.0 | tallow nitrile | 46.6 | 18.4 | 57.1 |
| 123 | 10.0 | nitrile pitch | 39.9 | 21.6 | 47.6 |
| 117 | 10.0 | filtered nitrile pitch | 52.8 | 19.0 | 63.1 |
| 124 | 10.0 | filtered amine nitrile pitch | 42.3 | 20.6 | 51.7 |
| 116 | 20.0 | filtered nitrile pitch | 54.4 | 19.0 | 66.3 |
| 125 | 20.0 | filtered amine nitrile pitch | 47.9 | 19.9 | 59.0 |

Once again the efficacy of the nitrile promoter is demonstrated by the above-tabulated results.

EXAMPLE 17

Nitrile promoters were epoxidized and evaluated on Ohio coal (about 27% ash content, particle size less than 14 Tyler mesh or 1.168 mm). Flotation reagents used were 10% promoter in #2 diesel oil collector at a total dosage of 0.30 g/kg, and 0.105 g/kg MIBC frother.

TABLE 17

| Run No. | Promoter Type | Concentrate (wt %) | Ash (wt %) | Coal Recovery (wt %) |
|---|---|---|---|---|
| 1787 | None | 48.4 | 14.6 | 55.7 |
| 1790 | $C_{16}$ olefin oxide (comparative) | 55.3 | 14.6 | 65.1 |
| 1789 | Soya nitrile | 59.2 | 14.0 | 69.4 |
| 1788 | Epoxidized soya nitrile | 63.5 | 15.0 | 74.3 |

Again, the efficacy of the promoters of the present invention is demonstrated.

EXAMPLE 18

Western Kentucky coal (about 25% ash content, particle size less than 28 Tyler mesh or 0.589 mm) and Ohio coal (about 28% ash content, particle size less than 14 mesh or 1.168 mm) was floated using 0.315 g/kg No. 2 diesel oil collector containing 10% by weight promoter and 0.105 g/kg MIBC frother. Long chain aliphatic alcohols and alkoxylated derivatives thereof were evaluated.

TABLE 18

| Run No. | *Promoter Type | Concentrate (wt %) | Ash (wt %) | Coal Recovery (wt %) |
|---|---|---|---|---|
| Western Kentucky Coal | | | | |
| 1603 | None | 27.7 | 13.5 | 32.2 |
| 1604 | Tallow alcohol | 52.3 | 12.7 | 61.3 |
| 1606 | Tallow alcohol + 8 moles PO | 58.9 | 12.6 | 68.6 |
| 1605 | Tallow alcohol + 10 moles PO | 60.0 | 12.2 | 70.7 |
| 1607 | Tallow alcohol + 8 moles PO/EO | 53.3 | 14.5 | 60.8 |
| 1609 | Tallow alcohol + 4 moles EO | 55.0 | 15.2 | 63.5 |
| 1608 | Tallow alcohol + 9 moles EO | 57.3 | 14.5 | 65.5 |
| Ohio Coal | | | | |
| 1582 | None | 36.9 | 14.1 | 43.4 |
| 1594 | Tallow alcohol | 52.6 | 14.8 | 61.6 |
| 1596 | Tallow alcohol + 8 moles PO | 63.8 | 15.4 | 74.7 |
| 1595 | Tallow alcohol + 10 moles PO | 65.0 | 15.3 | 76.4 |
| 1598 | Tallow alcohol + 8 moles PO/EO | 48.8 | 16.4 | 56.0 |
| 1599 | Tallow alcohol + 4 moles EO | 50.5 | 16.7 | 62.3 |

TABLE 18-continued

| Run No. | *Promoter Type | Concentrate (wt %) | Ash (wt %) | Coal Recovery (wt %) |
|---|---|---|---|---|
| 1598 | Tallow alcohol + 9 moles EO | 52.4 | 17.7 | 60.0 |

*PO is propylene oxide.
EO is ethylene oxide.

The above-tabulated data shows the efficacy of long chain alcohol promoters and alkoxylated derivatives thereof. Not shown in the data is the superior froth texture which the propoxylated alcohol promoters displayed relative to the ethoxylated alcohol promoters.

EXAMPLE 19

Ohio coal (32.5 ash content, particle size less than 14 Tyler mesh or 1.168 mm) and Western Kentucky coal (25% ash content, particle size less than 28 Tyler mesh or 0.589 mm) each were floated with a fatty acid promoter approximately 67% $C_{18}$, 30% $C_{16}$ and 3% $C_{14}$ fatty acids) and with varying degrees of the ethoxylates and propoxylates thereof. Polish Pat. No. 104569 proposes the use of ethoxylated higher fatty acids in coal flotation. The runs utilized 0.13 g/kg MIBC frother and 0.34 g/kg diesel oil collector plus promoter (10% by weight promoter in diesel oil collector in all runs).

TABLE 19

| Run No. | Promoter Type | Concentrate (wt %) | Ash (wt %) | Coal (wt %) |
|---|---|---|---|---|
| Western Kentucky Coal | | | | |
| 1989 | Fatty Acids | 54.1 | 15.5 | 61.2 |
| 1983 | Fatty Acids + 2 moles EO | 53.5 | 14.7 | 60.9 |
| 1985 | Fatty Acids + 5 moles EO | 48.3 | 15.1 | 54.9 |
| 1987 | Fatty Acids + 10 moles EO | 49.1 | 16.1 | 55.2 |
| 1990 | Fatty Acids + 3 moles PO | 55.8 | 14.7 | 63.7 |
| 1986 | Fatty Acids + 5 moles PO | 60.3 | 14.4 | 68.9 |
| 1988 | Fatty Acids + 10 moles PO | 58.9 | 15.0 | 67.2 |
| Ohio Coal | | | | |
| 1992 | Fatty Acids | 71.3 | 17.8 | 87.6 |
| 1993 | Fatty Acids + 2 moles EO | 71.3 | 16.6 | 88.3 |
| 1995 | Fatty Acids + 5 moles EO | 71.0 | 17.3 | 86.8 |
| 1997 | Fatty Acids + 10 moles EO | 66.7 | 18.2 | 81.3 |
| 1994 | Fatty Acids + 3 moles PO | 72.8 | 17.1 | 89.1 |
| 1996 | Fatty Acids + 5 moles PO | 74.8 | 18.2 | 90.6 |
| 1998 | Fatty Acids + 10 moles PO | 74.8 | 18.4 | 90.5 |

The foregoing data shows that the fatty acid promoter neat provides better coal yields and recoveries than the ethoxylate thereof, but that the propoxylate of the fatty acid promoter improves both yield and recovery. It is believed that the emulsification strength of the ethoxylate is detrimental to the float. The propoxylate and higher alkoxylates are not emulsifiers and, thus, improve the float compared to the fatty acid promoter. The unobviousness of fatty acid and higher ($C_3$ or greater) alkoxylates is proven.

I claim:

1. In a froth flotation process wherein solid coal particles are selectively separated under coal froth flotation conditions as a froth phase from remaining solid feed ash particles as an aqueous phase in the presence of a coal particle collector and a frother, the improvement characterized by the addition of an effective proportion of a hydrophobic, non-ionic promoter comprising a $C_{12}$–$C_{30}$ fatty alcohol or its $C_3$ or higher alkoxylated derivative.

2. The process of claim 1 wherein said fatty alcohol ranges in chain length from $C_{14}$–$C_{30}$.

3. The process of claim 2 wherein said chain length ranges from $C_{14}$–$C_{22}$.

4. The process of claim 1 wherein said promoter comprises the $C_3$ alkoxylated derivative of said fatty alcohol.

5. The process of claim 1 wherein said collector is a fuel oil.

6. The process of claim 1 wherein said frother comprises a frothing alcohol.

7. The process of claim 6 wherein said coal particles are conditioned with said collector, with said frothing alcohol, and with said promoter prior to said flotation.

8. The process of claim 1 wherein said promoter is used in a dosage ranging from about 0.005 to about 2 grams of promoter per kilogram of coal.

9. The process of claim 1 wherein said coal flotation conditions include the use of a fuel oil collector in a dosage of about 0.02 to about 2.5 grams per kilogram of coal, and a lower alkanol frother in a dosage of about 0.05 to about 0.5 g/kg of coal.

* * * * *